United States Patent [19]

Archer

[11] 4,264,858

[45] Apr. 28, 1981

[54] MEANS FOR REGULATING RESISTANCE CURRENT OF COMPLEX LOAD

[75] Inventor: William R. Archer, Fort Wayne, Ind.

[73] Assignee: General Electric Company, Fort Wayne, Ind.

[21] Appl. No.: 42,765

[22] Filed: May 29, 1979

[51] Int. Cl.[3] ..... H01T 19/00; G05F 1/08

[52] U.S. Cl. ..... 323/280; 361/235; 363/79; 355/3 CH

[58] Field of Search ..... 323/4, 20; 363/78–79, 363/95, 97; 361/235; 355/3 CH, 14 CH

[56] References Cited

U.S. PATENT DOCUMENTS

| | | | |
|---|---|---|---|
| 3,636,298 | 1/1972 | Risberg et al. | 323/20 |
| 3,772,585 | 11/1973 | Johnson | 361/235 |
| 3,896,287 | 7/1975 | Cook | 363/79 |
| 4,038,593 | 7/1977 | Quinn | 323/20 |
| 4,039,897 | 8/1977 | Dragoset | 323/20 |

*Primary Examiner*—William M. Shoop
*Assistant Examiner*—Peter S. Wong
*Attorney, Agent, or Firm*—Arthur E. Bahr; James H. Beusse

[57] ABSTRACT

A circuit means by which a high voltage, complex load may be precisely sensed and controlled. With high voltage AC loads, the effect of unavoidable stray capacitances is to render extremely difficult to measure and/or control that portion of total current which contributes actual power; that is, the resistive portion. Herein described is a circuit for rejecting all capacitive currents while measuring only the true resistive portion and deriving from the signal a filtered (averaged) voltage suitable for regulation and/or control. The circuit samples the total current only during the time when there is no capacitive current flowing. This sample is then compared with a reference, the difference amplified, and then averaged over many samples to derive a precise control signal.

8 Claims, 2 Drawing Figures

MEANS FOR REGULATING RESISTANCE CURRENT OF COMPLEX LOAD

BACKGROUND OF THE INVENTION

1. Field of the Invention:

The present invention relates to an electrical circuit for supplying high voltage AC electrical energy to a complex load, and more particularly, to such an electrical circuit for operating a high voltage corotron device, including means for regulating resistive current through the corotron.

2. Description of the Prior Art:

Prior art circuits for operating and regulating resistive current through a complex load, such as a corotron, leave much to be desired. One such circuit provides, as a portion of a high voltage output transformer coupled with an inverter, an extended winding to power a "compensating" capacitor connected to a corotron. The winding and capacitor are chosen so that current flowing in this capacitor is equal to, but opposite in polarity to, the capacitive current flowing in the shunt capacitive component of the load corotron. If this capacitor and the winding are properly chosen and adjusted, the only current flowing through a sensing resistor coupled serially with the load is the resistive component of that load. Such an arrangement leaves much to be desired in a circuit which should be precisely controlled, and is particularly very limited in its ability to compensate for variations in variable, stray, load capacitances. In addition, the choice of capacitance value and extra winding turns is a difficult one, indeed.

It is, therefore, an object of the present invention to provide an improved circuit for precisely regulating resistive current through a complex load.

SUMMARY OF THE INVENTION

In accordance with the present invention, there is provided in an electrical circuit of the type including a voltage-controlled inverter for supplying high voltage AC electrical energy to a complex load having variable resistive and variable shunt capacitive components, means for regulating resistive current through the complex load. The voltage-controlled inverter is of the type producing a waveform, at least a significant portion of each half cycle thereof having $dv/dt \simeq 0$. Included are means for connecting the output of the inverter to the complex load and means for sensing current flowing through that load. Means are provided for supplying a reference voltage as are means for comparing the sensed current with the reference and for producing an amplified difference. Means are provided for sampling the amplified difference as are means for obtaining a long-term average of many such sampled amplified differences. Means are then provided for applying long-term average to control the amplitude of the high voltage AC waveform supplied to the complex load.

DESCRIPTION OF THE PREFERRED EMBODIMENT

Figure 1:
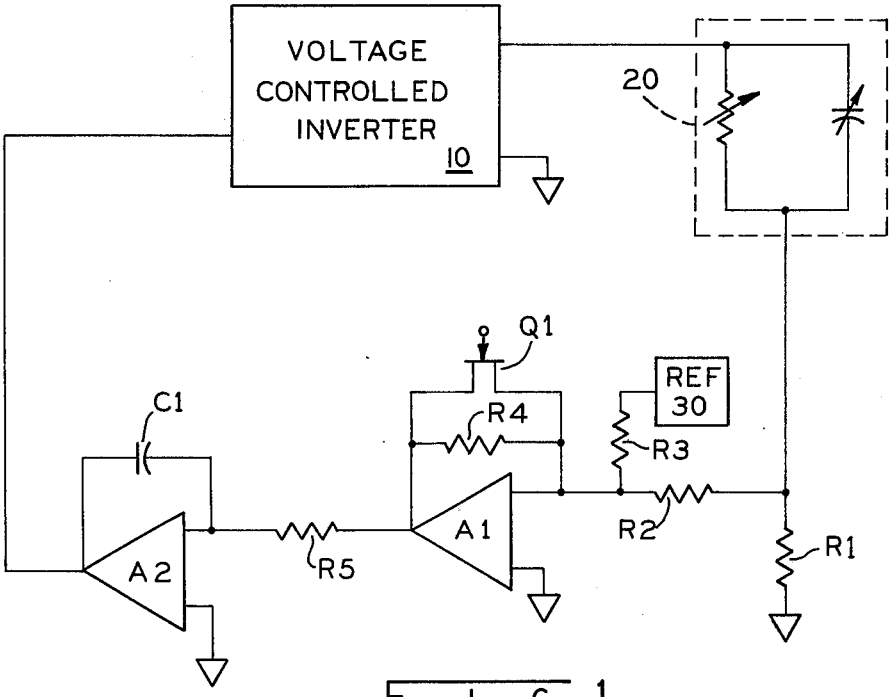
FIG. 1 shows by schematic representation the preferred embodiment of the control circuit of the present invention.

In accordance with the present invention, and referring now to FIG. 1, there is shown the preferred embodiment of an electrical circuit for supplying high voltage AC electrical energy to a complex load, the circuit having means for regulating resistive current through the complex load. A voltage controlled inverter 10 is provided for generating a high voltage AC waveform to be applied to the complex load. This complex load 20 includes variable resistive and variable shunt capacitive components, and simulates the resistive components supplied by a corona generating device called a corotron, typically used in reprographic equipment. The resistive component of complex load 20, the corotron, is shunted by a variable stray capacitance.

Voltage-controlled inverter 10 may be of any type capable of producing a waveform, at least a significant portion of each half cycle of which has a dv/dt approximately equal to zero. In other words, this waveform has a significant portion of each half-cycle during which the voltage does not change.

Figure 2:
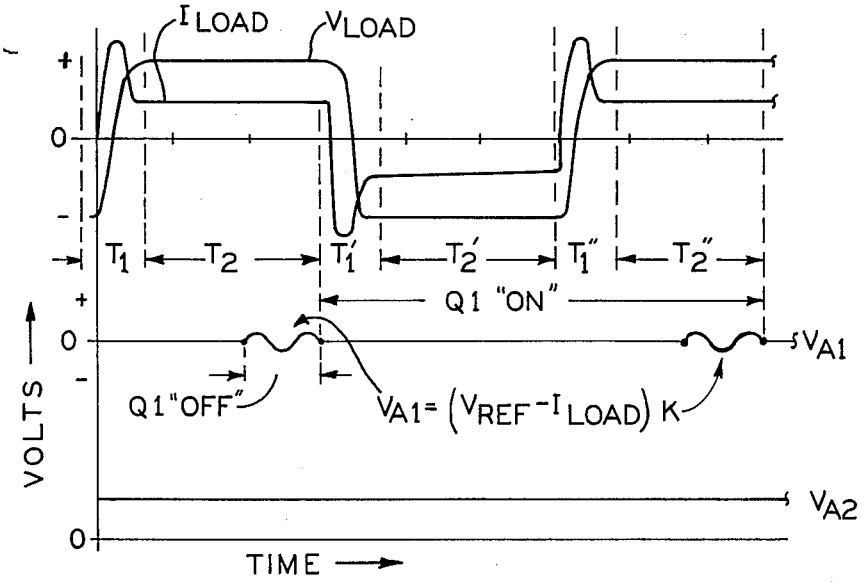
FIG. 2 is a graphic representation of the various waveforms taken from this preferred embodiment circuit.

In the waveform of FIG. 2, there is shown the voltage and current waveforms as typically provided to a charge corotron. During the times T1, T1', T1'', etc., the current waveform reflects capacitive current, and during the times T2, T2', T2'', etc., the current waveform reflects resistive current through the complex load. It is the purpose of this circuit to measure and regulate or control only that portion of the load current which is resistive.

Means are provided for sensing current flowing through the complex load, this in the form of a resistor R1. Means are also provided for supplying a reference voltage, this in the form of reference voltage source 30. Means are provided for comparing the sensed current with the reference voltage and producing an amplified difference, this including sampling comparison amplifier A1. Amplifier A1 compares the magnitude of the reference voltage from the reference source 30 with the magnitude of the voltage developed across sensing resistor R1. These two signals are monitored by resistors R2 and R3.

Means are provided for sampling the amplified difference at the output of amplifier A1, this including gate controlled FET Q1. FET Q1 acts as a bilateral or on/-off switch and is controlled so that we may ignore all parts of the waveform during which capacitive current flows; i.e., T1, T1', T1'', etc. The output $V_{A1}$ of amplifier A1 therefore is fixed to be zero except during that portion of the cycle in which only resistive current is flowing; i.e., T2, T2', T2'', etc. By design choice, however, such will only occur during a portion of the positive portion of the cycle; that is, during T2'', T2', etc. Such is accomplished by applying an appropriate control signal to FET Q1 so that it is turned on for all times except when the sample is desired. During the sample, FET Q1 is turned off. This can be seen graphically in FIG. 2 where the voltage $V_{A1}$, the output of amplifier A1, is shown.

The output voltage $V_{A1}$ of amplifier A1 is therefore equal to the amplified difference between the reference voltage and the voltage developed by the resistive portion of the load current during the sample interval and is essentially zero volts for any and all other segments of the cycle.

Means are also provided for obtaining a long term average of many such sampled amplified differences. Such is accomplished by fitting the output $V_{A1}$ of amplifier A1 into a long term integrator A2. Integrator A2 functions to average the output samples of amplifier A1 over many such samples to produce a relatively smooth output. Means are also provided for applying the long term average to control the amplitude of the high voltage AC waveform supplied to the complex load. The output $V_{A2}$ of the integrator A2 is applied to the control terminal of the voltage controlled inverter 10.

Operation of the system is essentially as follows. If the resistive portion of load current tends to increase for any reason, $V_{A1}$, the output voltage of amplifier A1, will tend to increase. This occurs because the current is compared with the fixed reference voltage and of course, due to the sampling, only the resistive portion is sensed. Because $V_{A1}$ increases; i.e., is more positive in polarity, the output of integrator A2 also increases, but in a negative direction. This causes the inverter control to reduce the output voltage of the inverter thus reducing the resistive load current. In conventional feedback loop control, the circuit thus maintains and controls the resistive load current. The circuit of FIG. 1 has operated satisfactorily with components having the following values or designations.

| | |
|---|---|
| Resistors | R1 - 1000Ω |
| | R2 - 100KΩ |
| | R3 - 5KΩ |
| | R4 - 100KΩ |
| | R5 - 10KΩ |
| Capacitor | C1 - 0.47 MFD |
| FET Q1 - 2N-5640 - Texas Instruments | |
| Amplifier A1 - RCA 324 (¼) | |
| Integrator A2 - RCA 324 (¼) | |

Voltage-controlled inverter 10 may be of any type capable of producing a waveform, at least a significant portion of each half cycle of which has a dv/dt approximately equal to zero. In other words, this waveform has a significant portion of each half-cycle during which the voltage does not change.

It should be apparent to those skilled in the art that the embodiment described heretofore is considered to be the presently preferred form of the invention. In accordance with the patent statutes, changes may be made in the disclosed apparatus and the manner in which it is used without actually departing from the true spirit and scope of this invention.

What is claimed is:

1. In an electrical circuit of the type including a voltage controlled inverter for supplying high voltage AC electrical energy to a complex load having variable resistive and variable shunt capacitive components, the voltage-controlled inverter producing a waveform at least a significant portion of each half cycle thereof having $dv/dt \simeq 0$, means for regulating resistive current through the complex load, comprising:

means for connecting the output of the inverter to the complex load;

means for sensing current flowing through the complex load;

means for supplying a reference voltage;

means for comparing a voltage derived from the sensed current with the reference voltage and for producing an amplified difference;

means for sampling the amplified difference;

means for obtaining a long-term average of many such sampled amplified differences; and means for applying the long-term average to control the amplitude of the high voltage AC waveform supplied to the complex load.

2. The invention of claim 1 wherein the current sensing means includes a resistor connected serially with the complex load across the output of the voltage-controlled inverter.

3. The invention of claim 1 wherein the means for supplying a reference voltage includes a reference voltage source.

4. The invention of claim 1 wherein the comprising means includes a sampling comparison amplifier having a pair of inputs and an output.

5. The invention of claim 4 wherein the sampling means includes a gate-controlled FET connected between one of the inputs and the output of the comparison amplifier.

6. The invention of claim 5 wherein the obtaining means includes a long-term integrator having a pair of inputs and an output, one of the inputs being connected to the output of the comparison amplifier.

7. The invention of claim 6 further including a capacitor connected between the output of the comparison amplifier and the output of the long-term integrator.

8. The invention of claim 6 wherein the applying means includes means for connecting the output of the long-term integrator to the control terminal of the voltage-controlled inverter.

* * * * *